US005252018A

United States Patent [19]

Kitahara et al.

[11] Patent Number: 5,252,018

[45] Date of Patent: Oct. 12, 1993

[54] SHEET BINDER

[75] Inventors: Makoto Kitahara, Tokyo; Kimiaki Hayakawa, Yokohama; Shuichi Yabe, Tsukuba, all of Japan

[73] Assignees: Canon Kabushiki Kaisha; Canon Aptex Kabushiki Kaisha, both of Tokyo, Japan

[21] Appl. No.: 913,976

[22] Filed: Jul. 16, 1992

Related U.S. Application Data

[63] Continuation of Ser. No. 500,570, Mar. 28, 1990, abandoned.

[30] Foreign Application Priority Data

Mar. 29, 1989 [JP] Japan ..... 1-076996
Mar. 29, 1989 [JP] Japan ..... 1-076997
Jul. 14, 1989 [JP] Japan ..... 1-181930

[51] Int. Cl.[5] ..... B42C 13/00

[52] U.S. Cl. ..... 412/11; 412/13; 412/20; 412/21

[58] Field of Search ..... 412/11, 13, 19, 20, 412/21, 33, 37, 900, 902; 156/908

[56] References Cited

U.S. PATENT DOCUMENTS 3,920,501 11/1975 Carlton et al. ..... 156/908
3,928,119 12/1975 Sarring ..... 412/37
3,973,787 8/1976 Staats et al. .
4,009,498 3/1977 Staats et al. ..... 156/583.9
4,863,332 9/1989 Wilholm et al. ..... 156/477.1

FOREIGN PATENT DOCUMENTS 67068 4/1987 Australia .
157234 10/1985 European Pat. Off. .
3805996 9/1988 Fed. Rep. of Germany .
8502945 5/1987 Netherlands ..... 412/33
1406012 6/1988 U.S.S.R. ..... 412/33
1258746 12/1971 United Kingdom .

*Primary Examiner*—P. W. Echols
*Assistant Examiner*—David P. Bryant
*Attorney, Agent, or Firm*—Fitzpatrick, Cella, Harper & Scinto

[57] ABSTRACT

A sheet material binding apparatus for binding sheet materials with a cover material by a heat-adhesive bonding agent includes a heating plate on which the spine of the covering material having the bonding agent is placed, the heating plate being used for heating the bonding agent; a guide for supporting the covering material and the sheet materials vertically on the heating plate; a guide driver for moving the guide in a direction of a thickness of a set of the sheet materials to facilitate setting and removing of the covering material and the sheet materials; and a controller for controlling the guide driver.

18 Claims, 16 Drawing Sheets

SHEET BINDER

This application is a continuation of application Ser. No. 07/500,570 filed Mar. 28, 1990, now abandoned.

FIELD OF THE INVENTION AND RELATED ART

The present invention relates to a sheet binder, more particularly to a sheet binder for binding edges of sheet materials and a spine of a covering material with a bonding agent.

Referring to FIG. 1, conventional sheet binder will first be described. The binder includes a main assembly 51 in which a heater 52 is fixed extending in a horizontal plane. It further includes guide plates 53 and 55 extending vertically above the heater 52, projections 53*a* and 55*a* extending in a horizontal plane substantially at the center of the guiding plates, pins 56 and 57 fixed on the projections, and horizontal elongated slot 59 for horizontally guiding the pins 56 and 57, the elongated slots 59 being formed in front and rear plates of the main assembly 51. A horizontal plate 60 is extended from the guide plate 53 toward the center of the apparatus, and a horizontal plate 61 is extended from the guide plate 55 in a horizontal plane and in parallel with the plate 60. The opposing surfaces of the plates 60 and 61 are formed into racks 60*a* and 61*a* adjacent an end. A pinion 62 is meshed with the racks 60*a* and 61*b*. A front side shaft of the pinion 62 is journaled in the front plate of the main assembly 51, and an end of the shaft is equipped with a knob 65.

In operation, a thickness of the set of the sheet materials 33 to be bound is measured by a separate measuring device, and a heating period is determined in accordance with the thickness. Then, the sheet materials 33 are sandwiched in a folded covering material 32 having a bonding agent 63 at the folded bottom portion. Subsequently, the knob 65 is rotated in the direction indicated by a broken line to expand the interval between the guides plate 53 and 55. Then, the covering material sandwiching the sheet materials 33 is inserted between the guide plates 53 and 55 to place it on the heater 52. Thereafter, the knob 65 is rotated in the direction of the solid line arrow until the sheet materials 33 are sandwiched by the guide plate 53 and 55. The heating period determined above is set in the apparatus, and then, the heater 52 is actuated, by which the heater 52 fuses the bonding agent 63 to adhere to the edges of the sheet materials 33 to the covering material 32.

When the heater 52 is deactuated (completion of the binding operation), the operator is notified of the completion by buzzer or the like. Then, the operator rotates the knob 65 in the broken line arrow direction to expand the interval between the guide plates 53 and 55, and the sheet materials 33 bound with the covering material 32 are taken out. Then, the sheet materials 33 and the covering material 32 are cooled by a separate cooling stand. The binding operation ends when the binding agent is solidified.

The conventional apparatus involves a drawback that the knob 65 has to be operated often to open and close the interval between the guiding plates 53 and 55. If, the confining force to the sheet material 33 is too strong, the binding strength becomes insufficient between the bonding agent 63 and the sheet materials 33. If it is too weak, the covering material 32 and the sheet materials are tilted, or become rhombus. Those are particularly remarkable when the thickness of the sheet materials 33 is large.

SUMMARY OF THE INVENTION

Accordingly, it is a principal object of the present invention to provide a sheet material binding apparatus in which the sheet material binding operation is simple and easy.

According to an aspect of the present invention, there is provided a sheet material binding apparatus wherein back edges of sheet materials and a bottom of a covering material are bound by heat-adhesive bonding agent, comprising heating means for heating the bonding agent, a pair of guiding members for confining the covering material and the sheet materials, and means for moving the guide member or members in a direction of the thickness of the sheet materials.

According to the present invention, the pair of guide members for confining and retaining the covering member is moved by a moving means, and therefore, there is no need for the operator to manipulate the knob for the opening and closing operation for the guide members, therefore, the labor for the binding can be saved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 1:
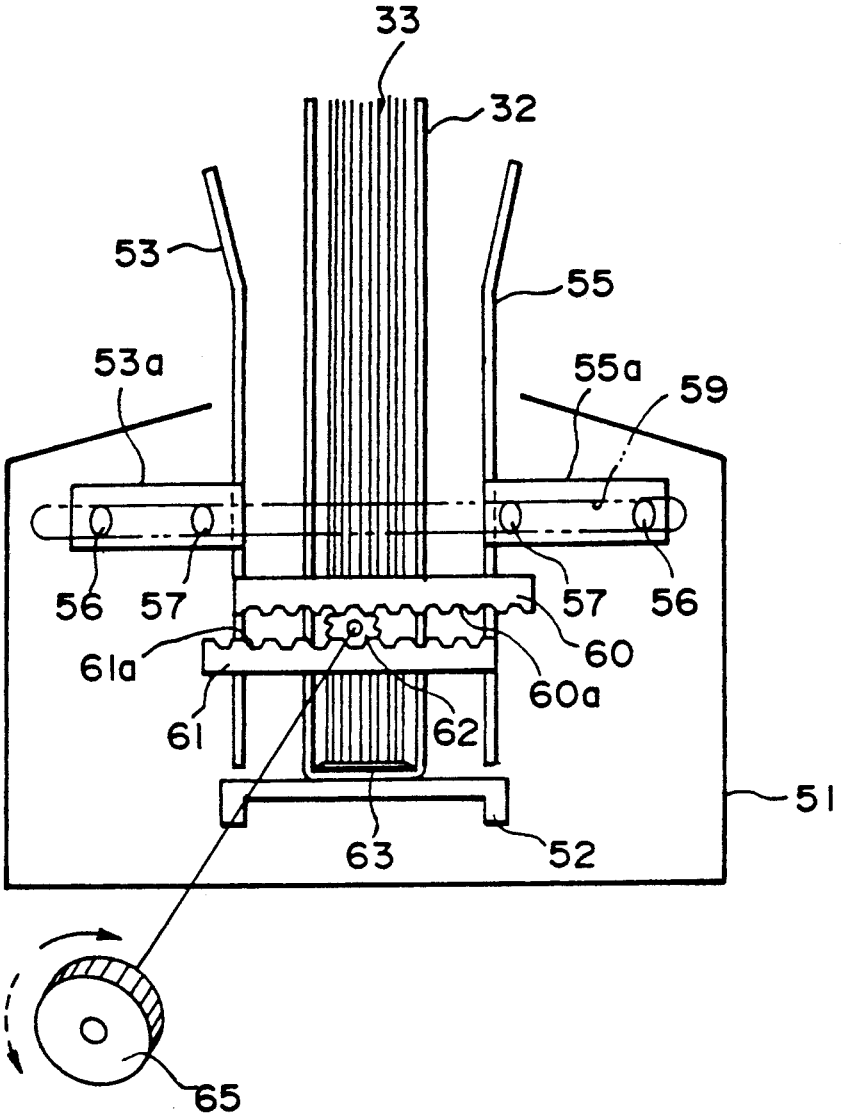
FIG. 1 PRIOR ART
FIG. 1 is a side view of a conventional binding apparatus.
Figure 2:
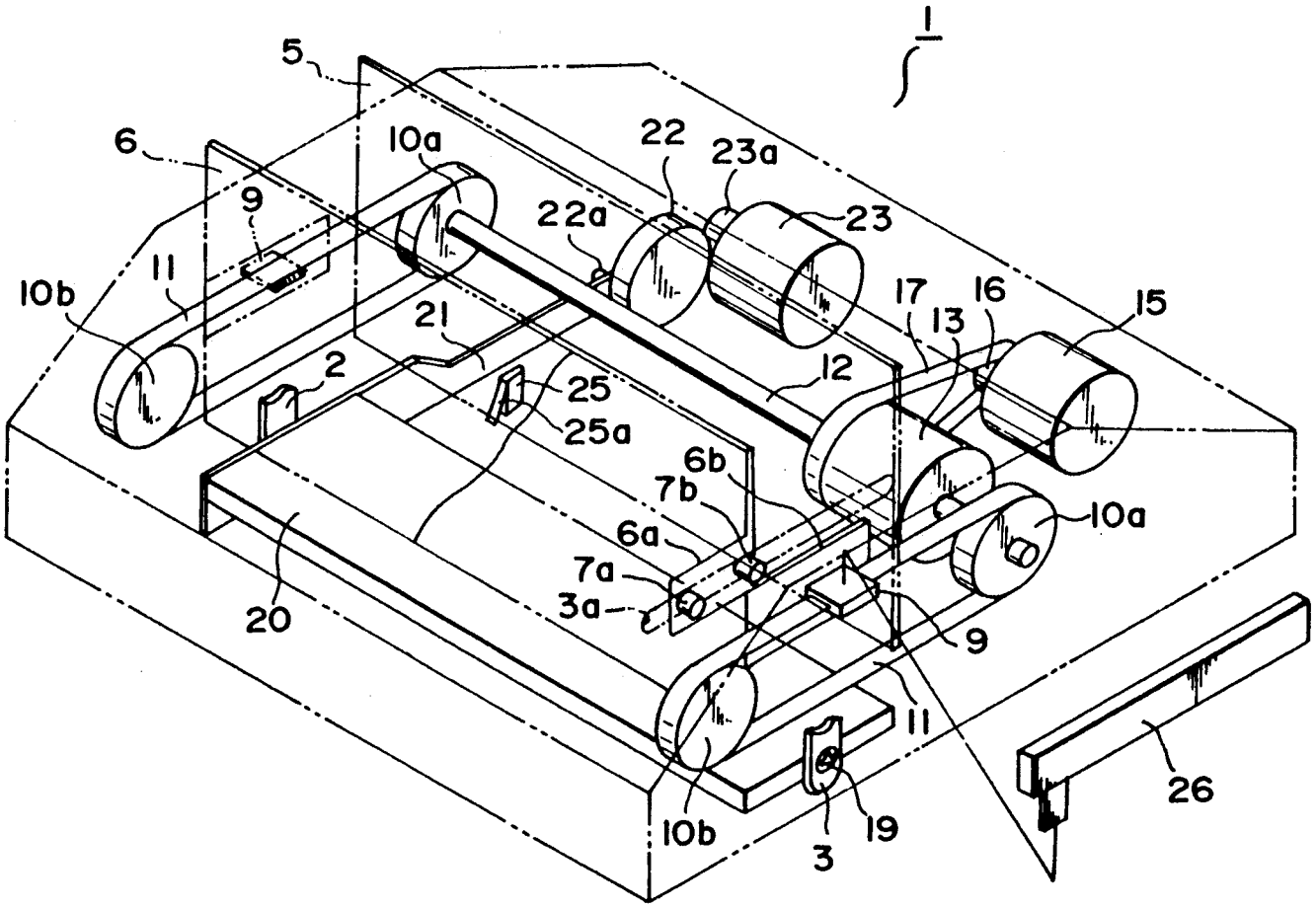
FIG. 2 is a perspective view of a binding apparatus according to an embodiment of the present invention.

Referring to FIG. 2, there is shown a sheet material binding apparatus 1. The binding apparatus 1 comprises side plates 2 and 3, to which a fixed guide plate 5 is mounted substantially vertically. The apparatus further comprises movable guide 6 from which tongues 6*a* and 6*b* are extended horizontally. The tongue 6*a* is provided with pins 7*a* and 7*b* projecting outwardly. The tongue 6*b* is provided with an outwardly and horizontally projecting portion 9. The pins 7*a* and 7*b* are guided along an elongated horizontal slot 3*a* formed in the side plate 3 (the side plate 2 has the same structure, although not shown in the Figure). To the insides of the side plates 2 and 3, a driving pulley 10*a* and a follower pulley 10*b* are mounted, around which a belt 11 is stretched. To the top travel portion of the belt 11, the above described horizontal projection 9 is mounted. The driving pulley 10*a* is fixedly mounted at each of the opposite longitudinal ends of the shaft 12. At a position between the opposite ends, a torque limiter 13 is mounted. A timing belt 17 is stretched around the torque limiter 13 and a pulley 16 fixed on an output shaft of a guide plate driving motor 15 fixed on the apparatus 1.

Figure 3A:
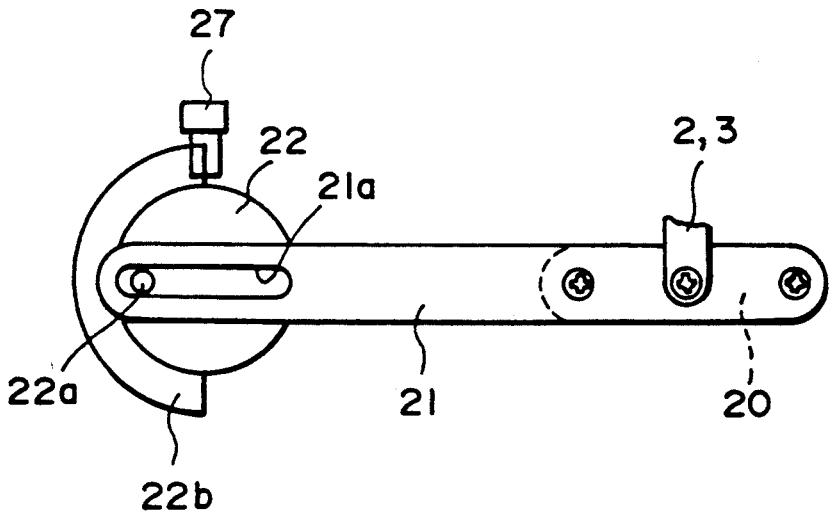
FIG. 3A is a side view of the apparatus wherein the heater is horizontal.
Figure 3B:
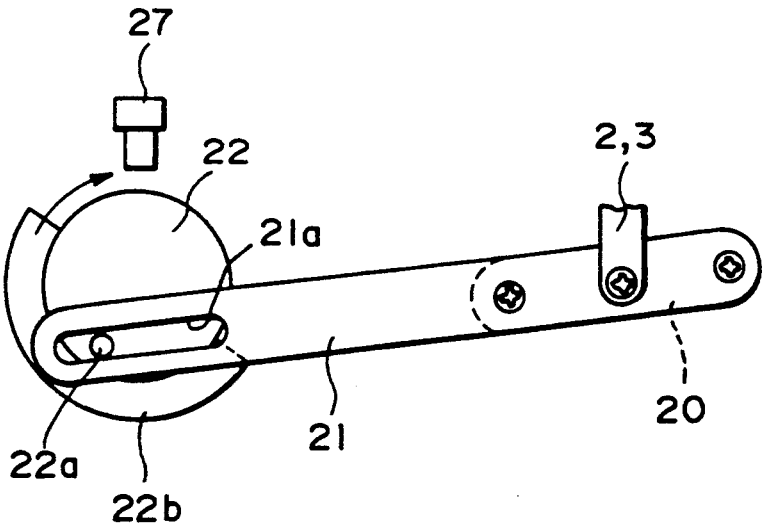
FIG. 3B is a side view wherein the heater is jogged (intermediate position).

A heater 20 is supported by pins 19 in the side plates 2 and 3 at central portions at the longitudinal end surfaces thereof. As shown in FIG. 3, an eccentric pin 22*a* of a cam gear 22 rotatably mounted on the apparatus 1 is inserted into an elongated slot 21*a* in an arm 21 extended from one end of the heater. The cam gear 22 is meshed with a gear 23*a* mounted on a heater jogging motor 23 fixed on the apparatus 1. The heater 20 is disposed below and close to the guide plates 5 and 6. A sensor 25 is mounted on the fixed guide plate 5, and a sensing element 25*a* of the sensor 25 is mounted on an inside of the guide plate 5 to detect the material inserted. To the horizontal projection 9, a slide volume 26 is mounted above the belt 11 in parallel therewith. As shown in FIG. 3, a heater position sensor 27 is disposed close to the cam gear 22 above the center thereof. A flange 22*b* is provided on a half circumference of the cam gear, the circular flange 22*b* has a center coincident with the rotational center of the cam gear 22. By an end of the flange 22*b*, the sensor 27 is actuated or deactuated.

Figure 4A:
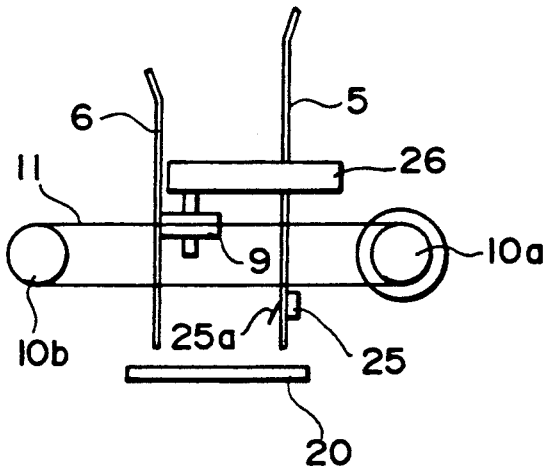
FIG. 4A is a side view of guide plates which are opened.
Figure 4B:
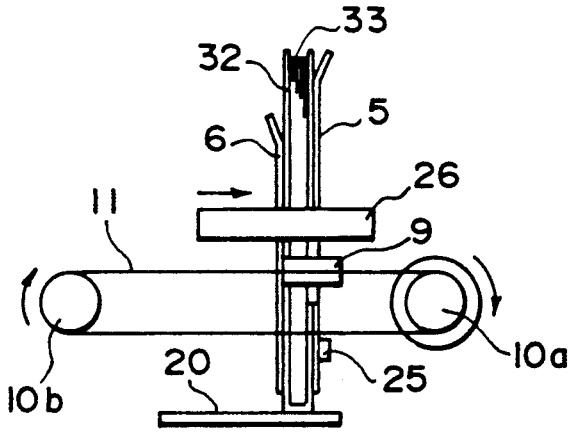
FIG. 4B is a side view of the guide plates wherein they are closed with a predetermined pressure.
Figure 4C:
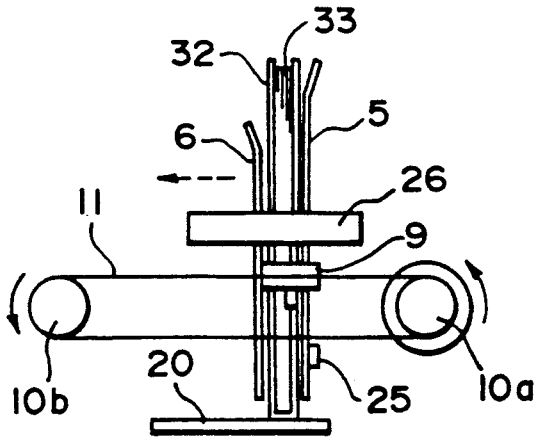
FIG. 4C is a side view of the guide plates wherein the guide plates are opened for a short period of time to provide a clearance.
Figure 5:
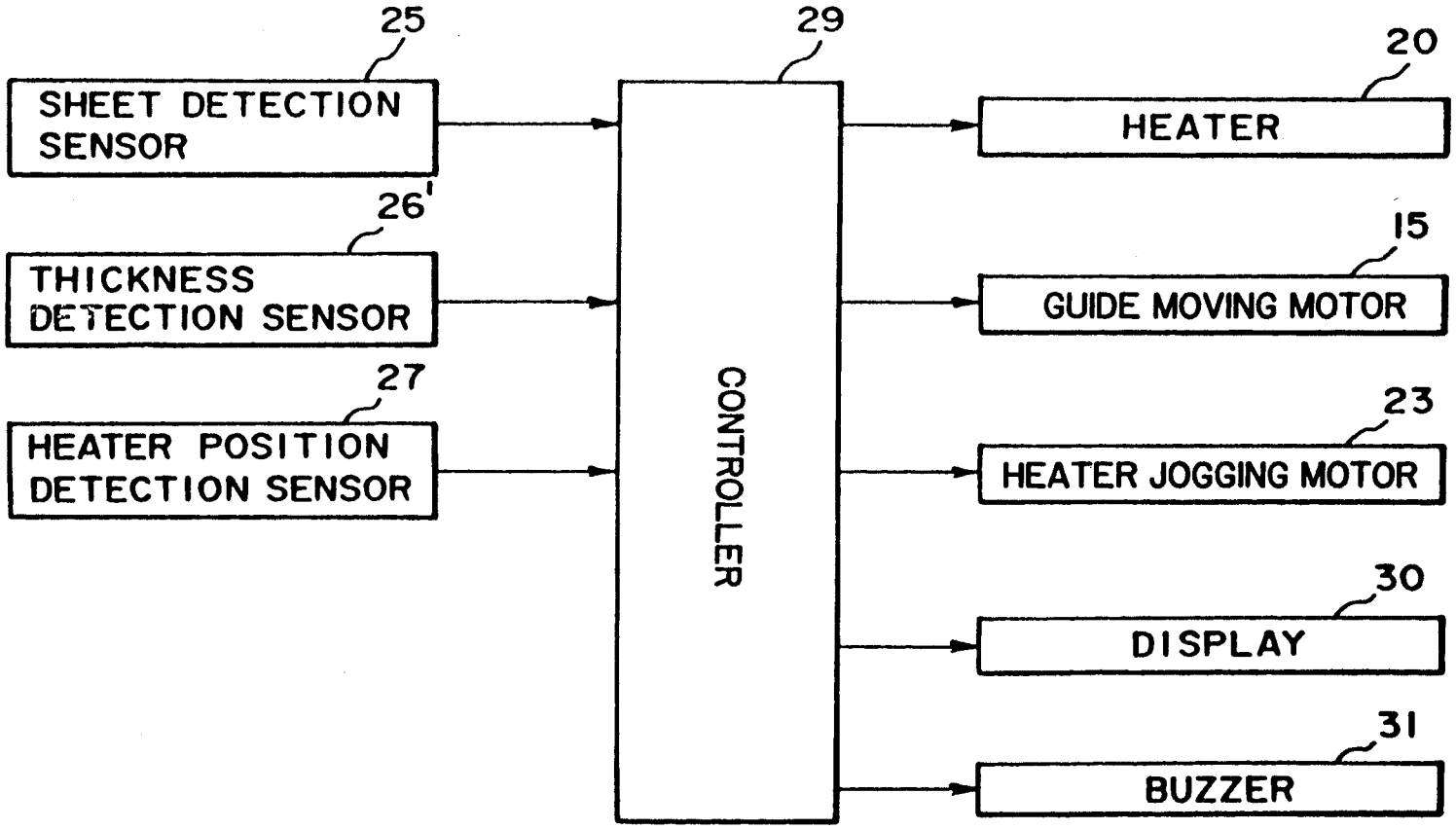
FIG. 5 is a block diagram for a control system of the binding apparatus.

As shown in FIG. 5, a control system 29 receives output signals from the sensor 25 for detecting the presence or absence of the sheet materials, the thickness detection sensor 26' constituted by the slide volume 26 (shown in FIGS. 4A–4C) and the heater position sensor 27. The control system 29, responsive thereto, supplies the drivers for the heater 20, the guide plate moving motor 15, the heater jogging motor 23, a display 30 and the buzzer 31, so that these elements are driven. The apparatus is further controlled by an unshown sensor for the heater 20, a timer in the control system 29 and memory means thereof.

In operation, the power supply to the sheet material binding apparatus 1 is started, then a covering member 32 having a heat-adhesive bonding agent at the bottom thereof is inserted together with the sheet materials to be bound with the covering material, sandwiched by the covering material 32. By the actuation of the power switch of the apparatus 1, the heater 20 is supplied with electric power, and when the heater 20 reaches a preheating temperature, permission of the covering member 32 setting is displayed on the display 30 as shown in FIG. 5.

Then, the covering member 32 together with the sheet materials 33 sandwiched thereby is inserted between the guides 5 and 6.

When the covering member 32 is detected by the sensor 25, the guide moving motor 15 is actuated with a time delay $t_0$ determined by an unshown timer. This moves the movable guide plate 6. The period of the movement is such that it is sufficient to sandwich the covering material 32 together with the sheet material, and therefore, when the thickness of the set of the sheet materials 33 is large, the torque limiter 13 slides for a long period, whereas when it is thin, the sliding period is short. Thus, a predetermined pressure is applied to the sheet materials 33 by the guide plate moving motor 15 due to the provision of the torque limiter 13.

Another example for this function is that the output of the motor 15 is properly selected, and the motor 15 is locked when the pressure exceeds a predetermined pressure level, by which the constant pressure can be provided without use of the torque limiter 13. At this time, the stop position of the movable guide plate 6 is detected by the slide volume 26, by which the thickness of the set of the sheet materials 33 is detected. The detection signal is transmitted to the control system 29, which determines the heating period $t_1$ (approximately 30 sec for the thickness of 10 mm), and actuates the heater 20 (approximately 150° C.), so that the covering material is heated for the period $t_1$. The determined heating period $t_1$ is displayed on the display 30 (the remaining period may be displayed to notify the operator of the remaining period for the operators convenience).

Figure 7:
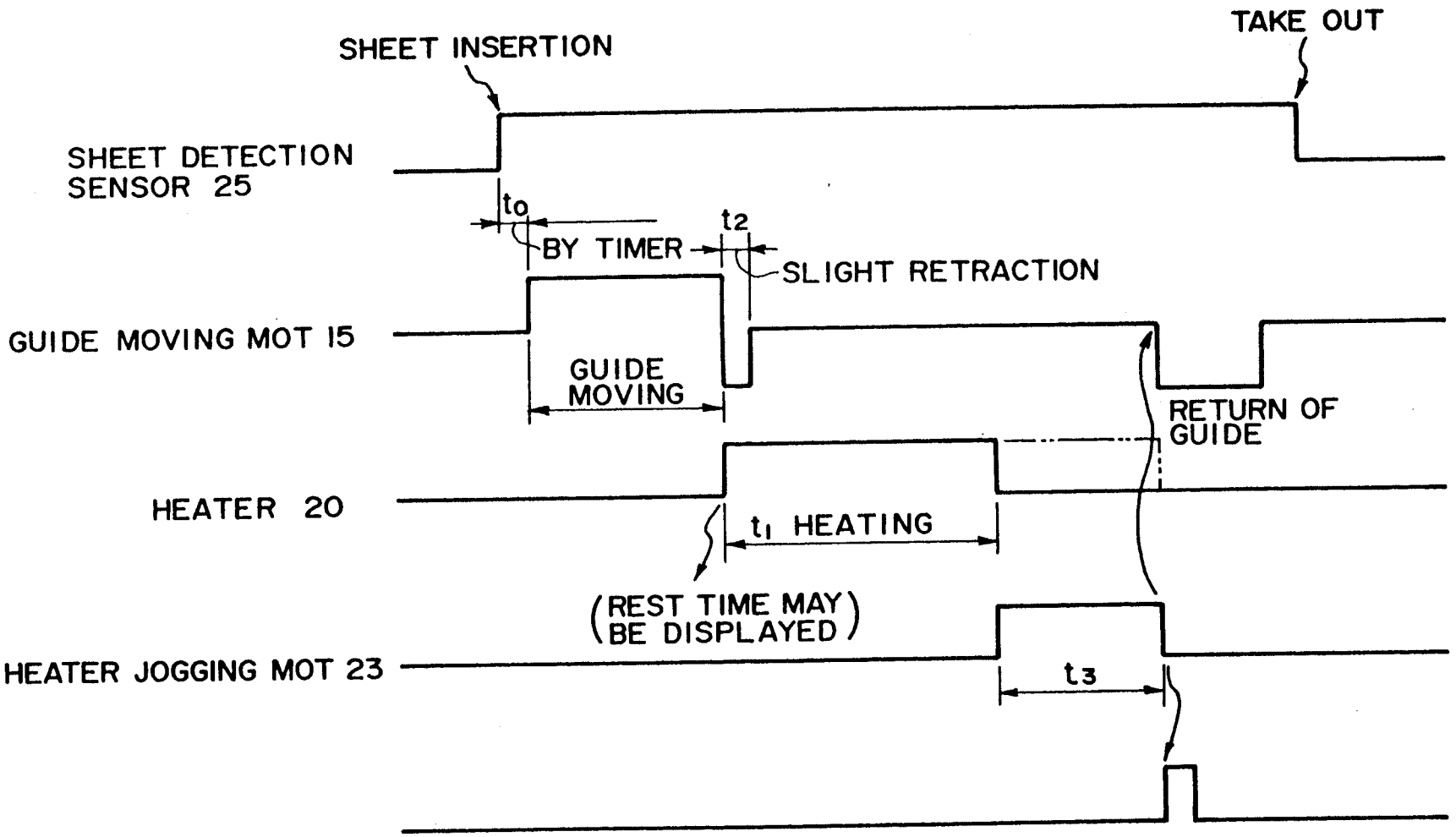
FIG. 7 is a time chart showing timing of operations of various elements.

After the start of the heating, the guide moving motor 15 is rotated in the opposite direction to add a small clearance (1 mm–2 mm approximately) to the interval between the guide plates 5 and 6 after a small reverse period $t_2$, by which the impregnation of the bonding agent is improved (by increasing the reverse period $t_2$ with increase of the thickness of the set of sheet materials 33, by which the impregnation of the bonding agent is further improved). After the heating period $t_1$ elapses, the control system 29 determines a jogging period $t_3$ (approximately 10 sec), and the heater jogging motor 23 rotates for the period $t_3$. This improves the alignment of the sheet materials 33 and increases the impregnation of the bonding agent liquefied by the heat in between the adjacent sheet materials 33 (the period $t_3$ may be increased with the thickness of the set of the sheet materials 33 to improve the alignment and impregnation). As shown in FIG. 7 by chain lines, the heating may be continued during the jogging operation.

After the completion of the jogging operation for the period $t_3$, the buzzer 31 is actuated to notify the operator of the finishing (simultaneously, a display to that effect may be made), and simultaneously, the guide moving motor 15 is rotated reversely to expand the interval between the guide plates 5 and 6 to be prepared for the next binding operation. The heater 20 is stopped when it takes the horizontal position, that is, the position convenient for the next operation, by stopping the motor 23 actuation, deactuation of the heater position detecting sensor 27, or at the instance of the switching between the off-state and the on-state thereof.

Then, the sheet materials 33 and the covering material 32 now having the bonding agent properly adhered, are taken out together from between the opened guide plates 5 and 6, and is set in a cooling stand (not shown) to cool and solidify the bonding agent. The sheet binding operation is completed upon solidification of the bonding agent.

Figure 6A:
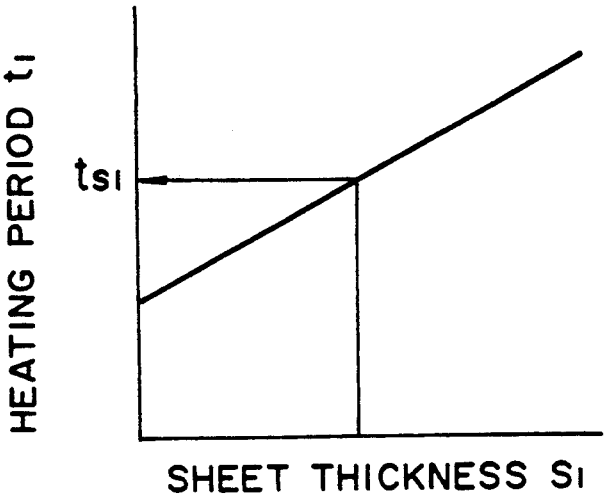
FIG. 6A is a graph showing a relation between a thickness of a set of sheet materials and proper heating period.
Figure 6B:
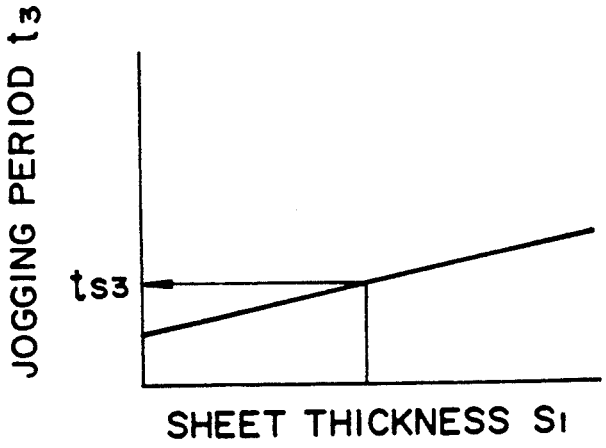
FIG. 6B is a graph showing a relation between the thickness of a set of the sheet materials and a jogging period.
Figure 6C:
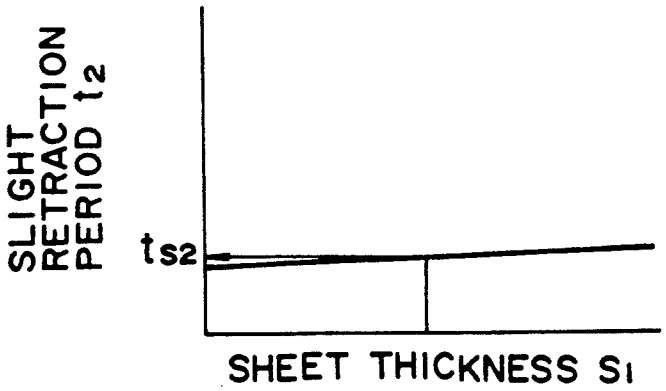
FIG. 6C is a graph showing a relation between the thickness of a set of the sheet materials and proper clearance formation time.

Referring to FIG. 6A, between the thickness S1 of the set of the sheet materials 33 and the proper heating period $t_1$ of the heater 20, there is a substantially linearly increasing relation. As shown in FIG. 6B, between the thickness S1 of the set of sheet materials 33 and the jogging period $t_3$ there is the same relationship. As shown in FIG. 6C, the same applies to between the thickness S1 of the set of sheet materials 33 and the short reversing period $t_2$. The change may be stepwise rather than continuous.

FIG. 7 shows the above operation in a time sequential order.

In place of the contact sensor 25, a transparent type sensor may be used to detect the presence or absence of the sheet materials.

In this embodiment, only the movable guide plate 6 is moved, but it is possible that the guide plate 5 which is fixed in this embodiment may be made movable.

In this embodiment, the thickness is detected by the slide volume 26, and the short reverse period $t_2$ and the jogging period $t_3$ are controlled. However, those controls are not inevitable to the present invention, and therefore, they may be omitted.

In place of the heating period $t_1$, the heating temperature may be changed in accordance with the thickness of the set of sheet materials, more particularly, the heating temperature is increased with increase of the thickness.

In the embodiment, after the completion of the heating operation, the guide plate 5 and 6 are opened automatically. However, this is not limiting, and the guide plates 5 and 6 are not opened upon the completion of the heating operation, but they may be opened when the operator takes the bound sheet materials out.

Referring FIGS. 8–12, a second embodiment of the present invention will be described.

Figure 8:
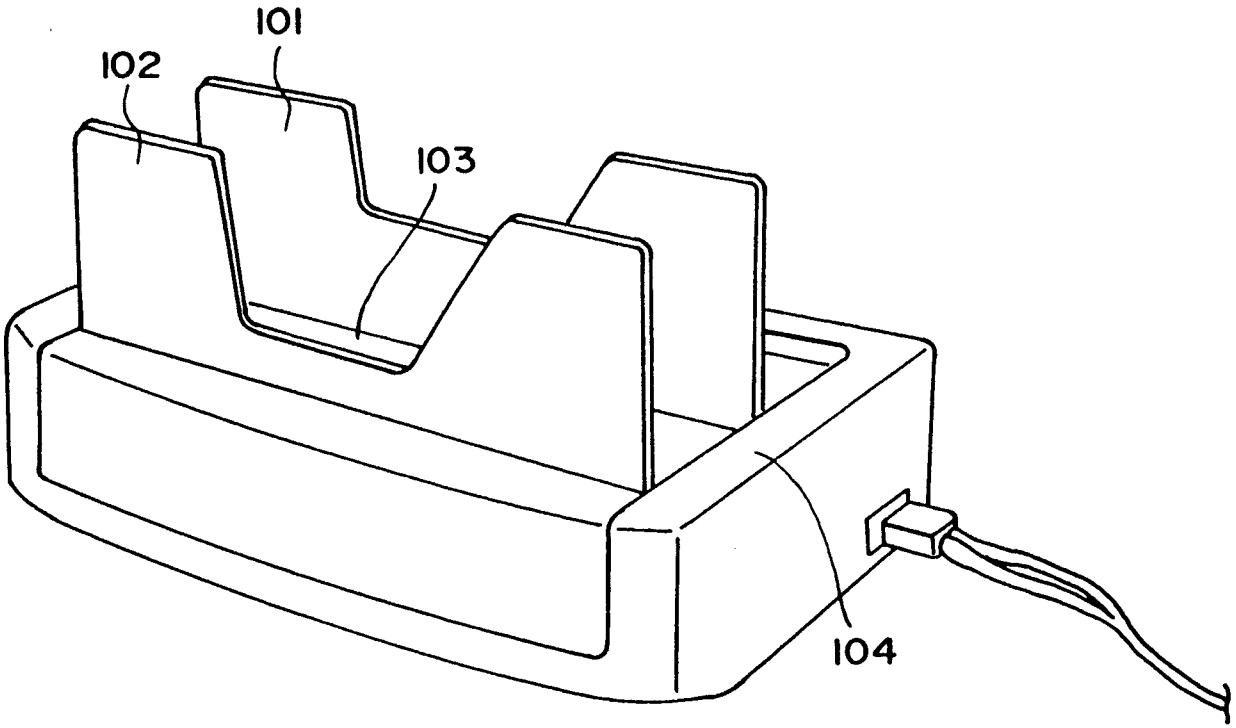
FIG. 8 is a perspective view of binding apparatus according to another embodiment of the present invention.

FIG. 8 is a perspective view of a binding apparatus (thermal binder) according to this embodiment. The apparatus comprises a fixed guide plate 101, a movable guide plate 102, a swingably vibratable heater plate 103 and a side cover 104. The inside surface of the side cover 104 functions as a lateral guide. The guides 101 and 102 may be folded to be overlapped to each other to facilitate to carry it around that is, the top of the apparatus becomes substantially flat.

The operation will be described.

FIGS. 9A, 9B, 9C and 9D are perspective views illustrating operation of the binder.

Figure 9A:
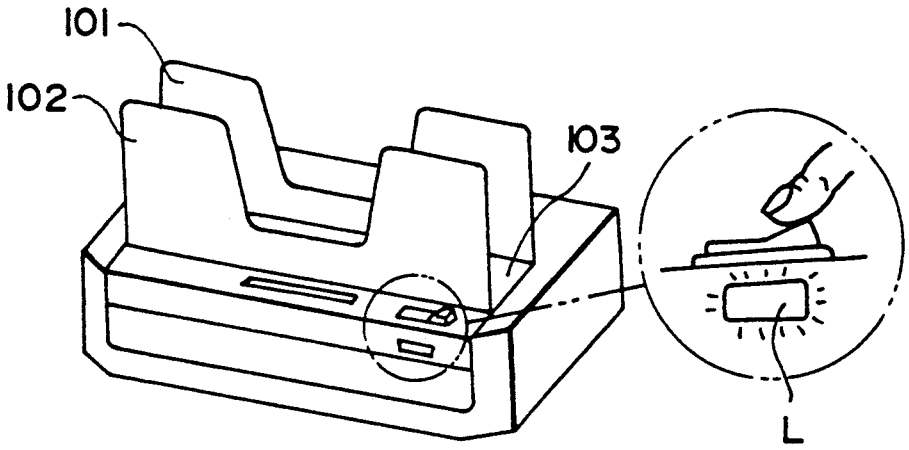
FIGS. 9A, 9B, 9C and 9D are perspective views illustrating operation of the apparatus.

(1) The start button is actuated to start power supply (FIG. 9A). The power lamp L is flickered, and the heater plate starts to be heated (pre-heating).

(2) The power lamp becomes continuously on-state upon completion of the pre-heating (30 sec, 60° C.).

Figure 9B:
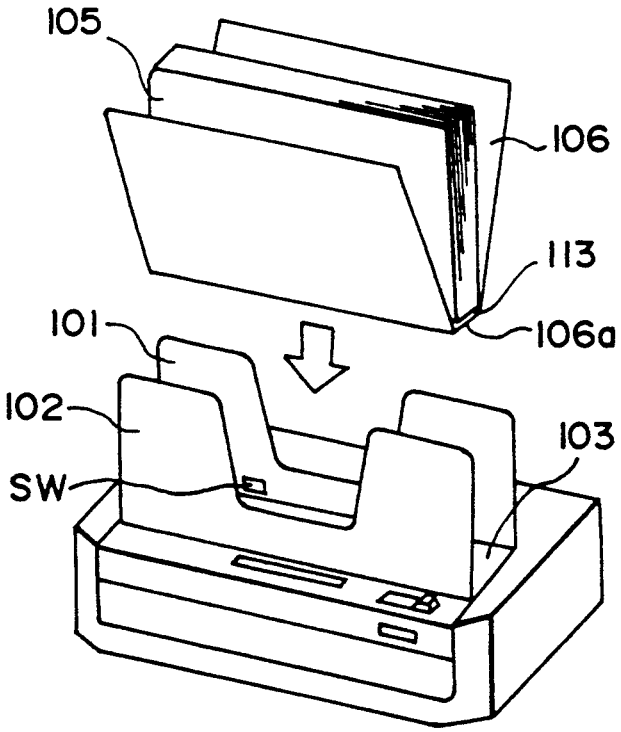

(3) A cover 106 is selected in accordance with the thickness of the set of sheet materials 105 to be bound, and the sheet materials 105 are sandwiched by the cover 106. A heat-fusable bonding layer 113 is applied on the inside of the spine **106*a* of the cover 106. On the layer 113, the edges of the sheet materials 105 to be bound is set (FIG. 9B**).

The cover 106 sandwiching the sheet materials 105 is inserted in between the guide plates 101 and 102, and is placed on the heater plate 103.

Figure 9C:
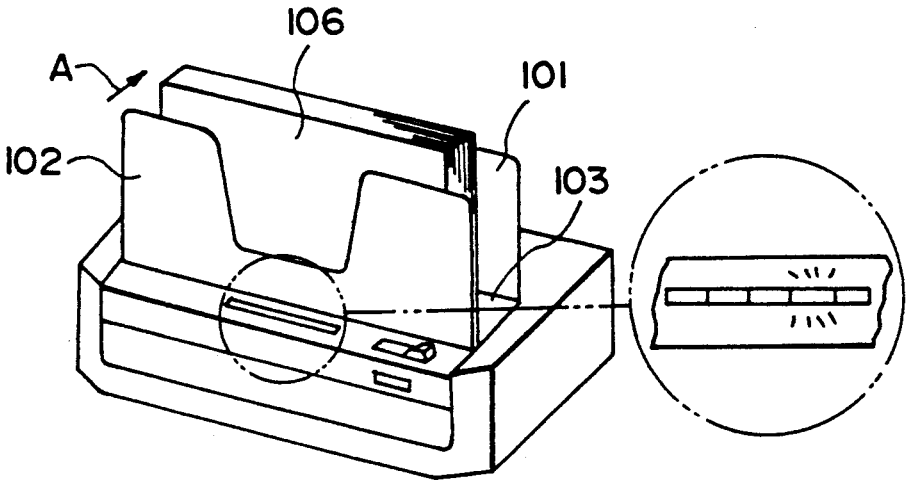

(4) When the insertion of the sheet materials is detected by a switch SW in the apparatus, the movable guide plate 102 moves in the direction indicated by an arrow A to sandwich the sheet materials and the cover 106 between the movable guide plate 102 and the fixed guide plate 101. Thereafter, the movable guide plate 102 is reversely moved (approximately 2 mm), to relatively loosely sandwich the cover 106 and the sheet materials. At this time, even if the guide plate 102 is reversed, the cover 106 expands by its elasticity, so that the cover 106 is supported by the guide plates 101 and 102. Simultaneously, the heater plate 103 starts to be heated. The heating period is 60 sec, in which the temperature thereof reaches 130° C. After the bonding agent layer 113 starts to fuse by the heat (48 sec after the heating), the swinging vibration of the heater plate 103 starts its swinging vibration and continues for 12 sec. The remaining period is displayed by a lamp which is counted down (FIG. 9C).

Figure 9D:
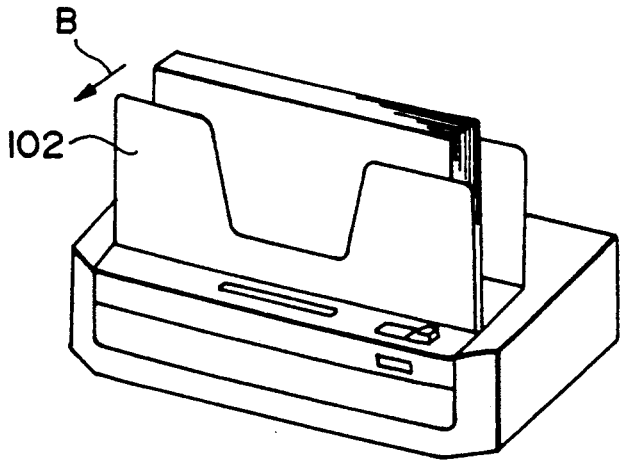

(5) After the predetermined heating period (60 sec) elapses, the vibration ends, and the ending is notified to the operator by buzzer (FIG. 9D).

(6) The set of sheet materials and the cover now bound are taken out together. When they are taken out, the movable guide plate 102 is moved away from the other guide plate (in the direction B) to its home position (FIG. 9A). The sheet materials are placed on a cooling table on which the sheet materials are placed vertically with the bound portion **106*a*** at the bottom by being sandwiched by proper means.

The heater plate will be described in detail.

Figure 10:
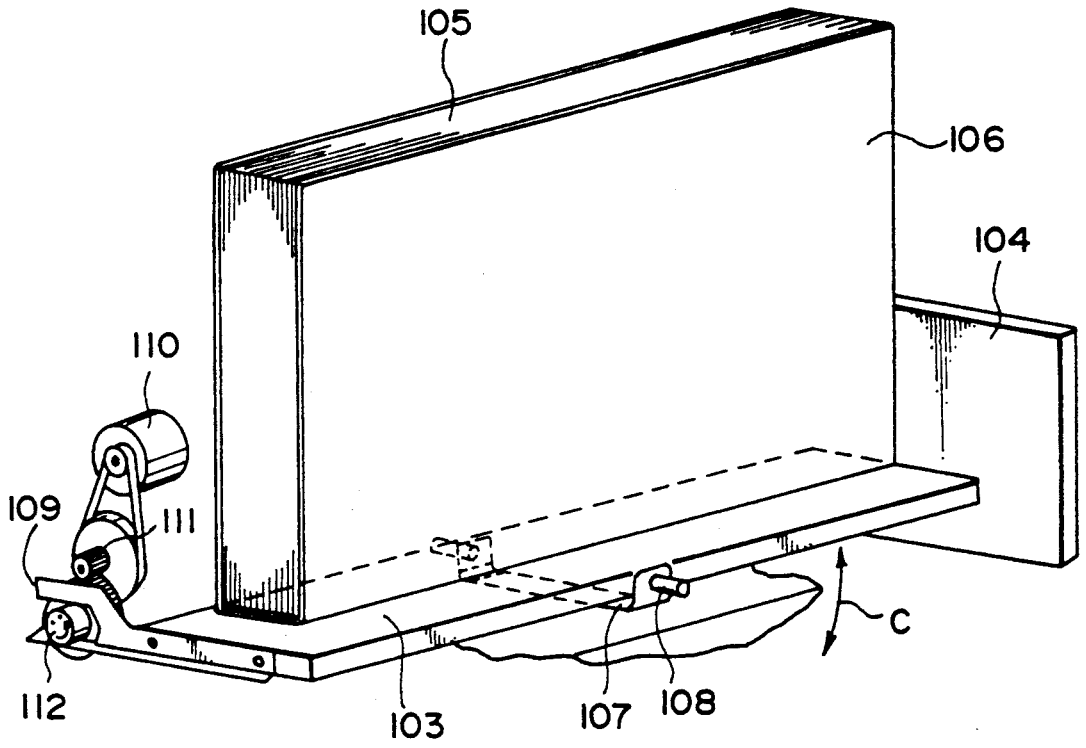
FIG. 10 is a perspective view illustrating swinging movement of the heater plate.

FIG. 10 is a perspective view for swinging the heater plate 103.

The heater plate 103 is swingably supported (direction C) by a shaft 108 substantially at the center of the heater plate.

The shaft 108 is planted on a holding means 107 fixed on the apparatus. A forked plate 109 is fixed to an end of the heater plate 103. The forked portion is engaged with an eccentric cam 112 rotatably supported on the apparatus. Therefore, when the eccentric cam 112 rotates by the motor 110 through a gear train 111, the heater plate 103 reciprocally swings about the shaft 108 in the direction C.

The swinging movement of the heater plate will be described.

Figure 11A:
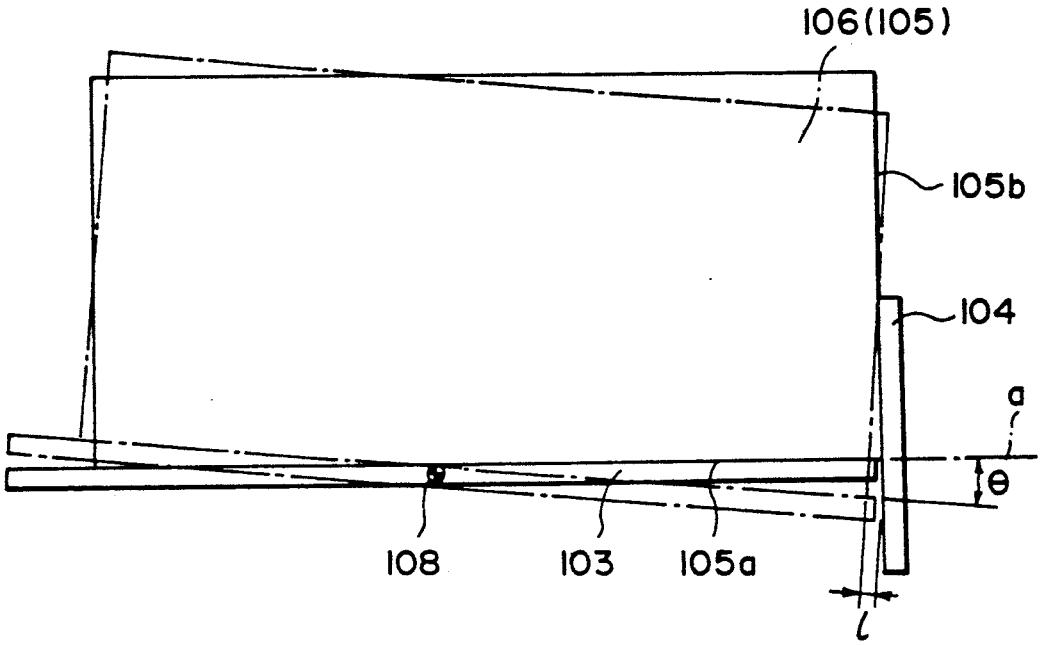
FIGS. 11A and 11B are front views illustrating movement of the heater plate and the sheet materials.

As shown in FIG. 11A, the swinging movement of the heater plane occurs between the horizontal plate a and the inclined state by the angle $\theta$. The angle $\theta$ is approximately 1 degree in this embodiment. The frequency is 3 reciprocations per 1 sec. The operator sets the sheet materials at the solid line position in FIG. 11A. By the first lowering swing of the heater plate, the end edges **105*b* of the sheet materials makes an arcuate movement with the lateral guide 104 fixed, and therefore, end edges 105*b* of the sheet materials are pushed to the lateral guide 104, so that they are pushed back to the chain line position through a distance 1**.

Figure 11B:
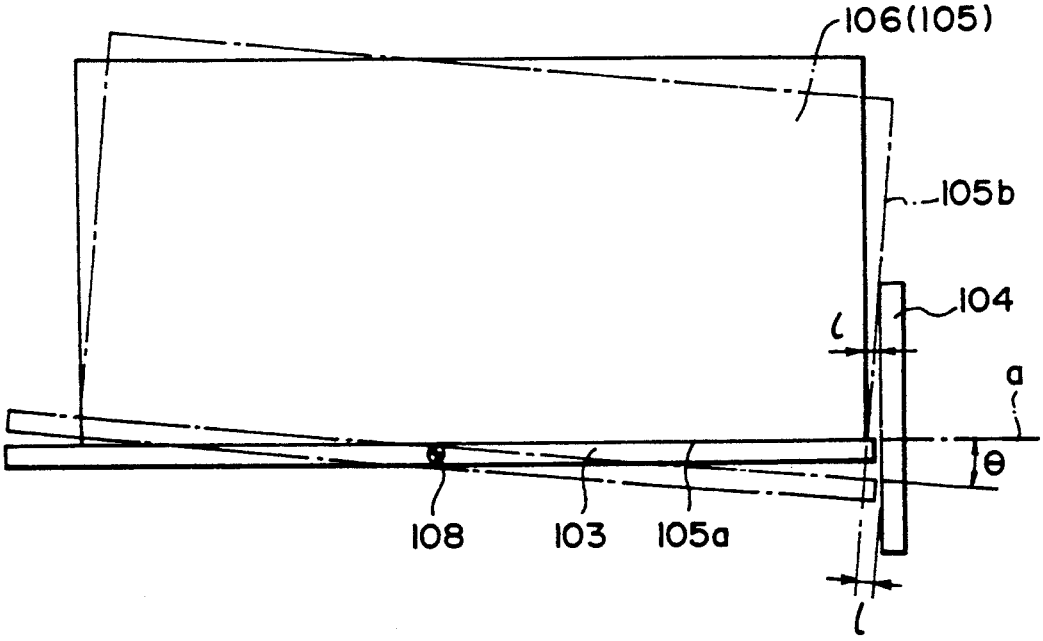

With continuance of the swinging vibration, the end edges 105*b* of the sheet materials are softly abutted to the lateral guide 104 in each of the reciprocations. The right end of the heater plate does not move upwardly beyond the horizontal plane a. Therefore, when the heater plate 103 moves upwardly, the sheet materials are elevated while the distance 1 is being kept, and therefore, they do not displace (FIG. 11B).

The reason why the heater plate is swung will be described.

Figure 12A:
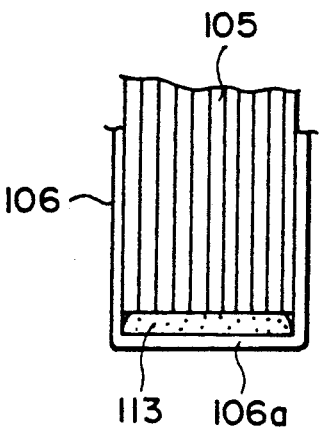
FIG. 12A, 12B, 12C, 12D and 12E are side views illustrating movement of the sheet materials.
Figure 12B:
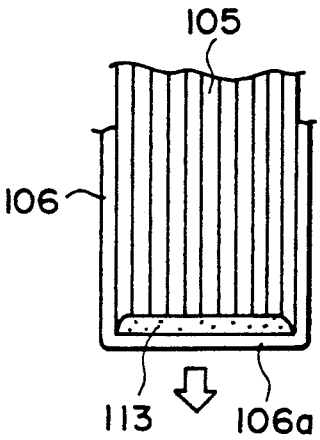
Figure 12C:
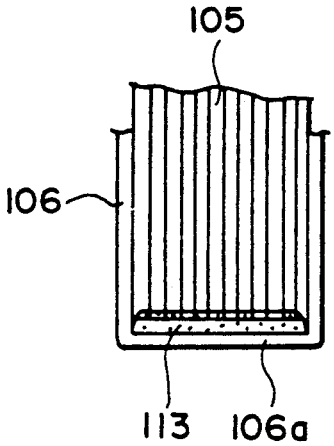
Figure 12D:
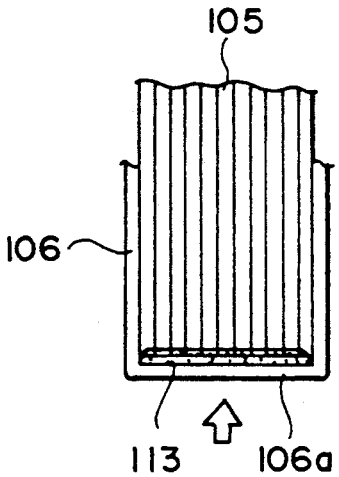
Figure 12E:
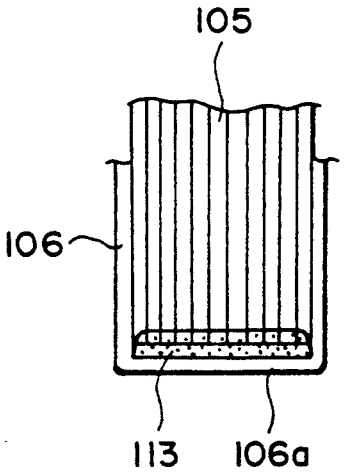
Figure 13:
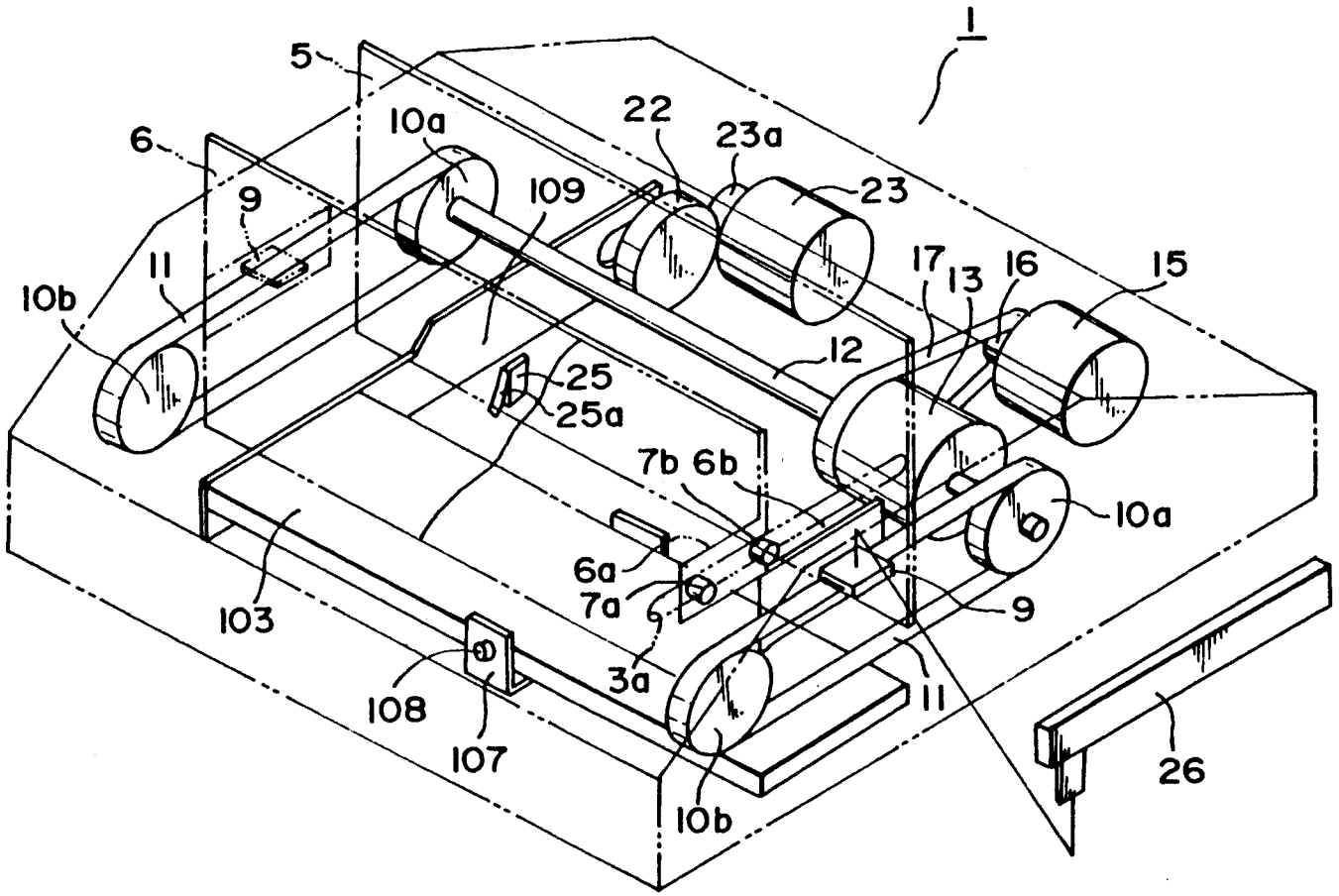
FIG. 13 is a perspective view of a binding apparatus according to a further embodiment of the present invention.

In this embodiment, the sheet materials are vibrated by the swinging movement of the heater plate, by which the bonding agent is impregnated in between adjacent sheet materials. The principle thereof will be described. As shown in FIGS. 12B and 12C, when the cover 106 is lowered by the downward swing of the heating plate and then instantaneously stopped, the sheet materials encroach into the bonding agent layer 113. When the cover 106 is elevated as shown in FIG. 12D, the bonding agent layer 113 is elevated against the weight of the sheet materials 105, and therefore, the sheet materials further encroach into the bonding material layer 113. By the repetition of the upward and downward vibration, the sheet materials encroach into the bonding layer 113.

Referring to FIGS. 13–16, a third embodiment will be described, wherein the heating plate which swings as described with FIG. 11 is incorporated into the apparatus of FIG. 2. The same reference numerals as in FIGS. 2 and 10 are assigned to the elements having the corresponding functions, and the detailed description thereof are omitted for simplicity.

Figure 14:
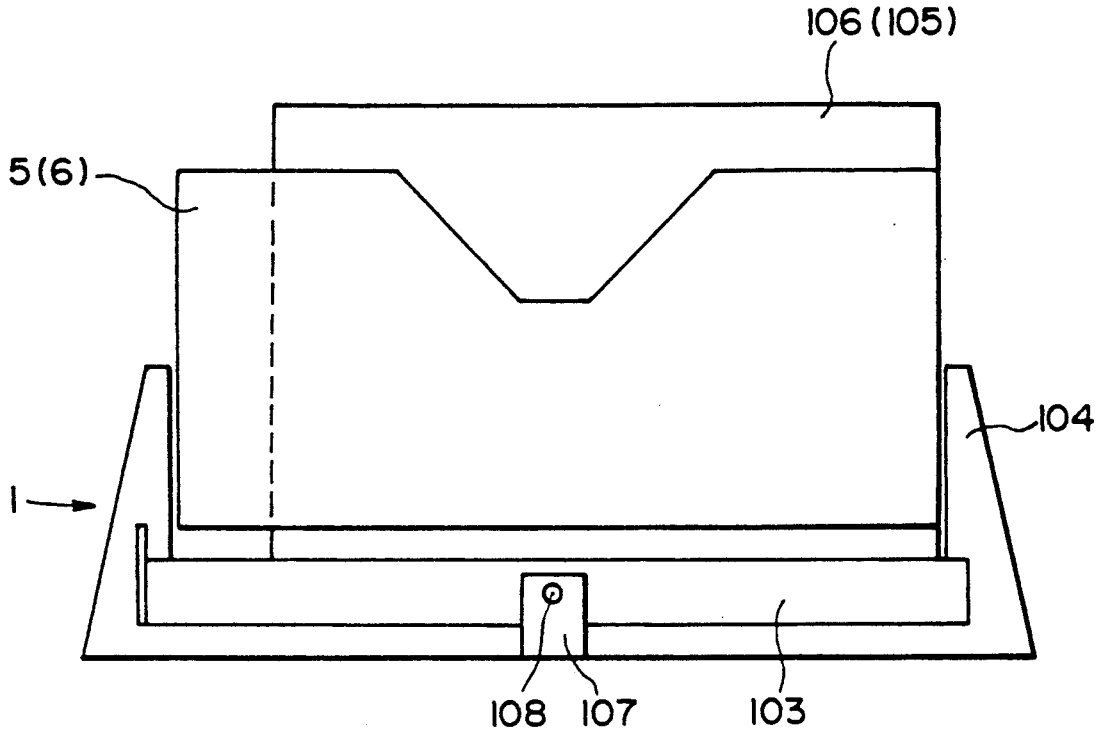
FIG. 14 is a front view of the apparatus.
Figure 15:
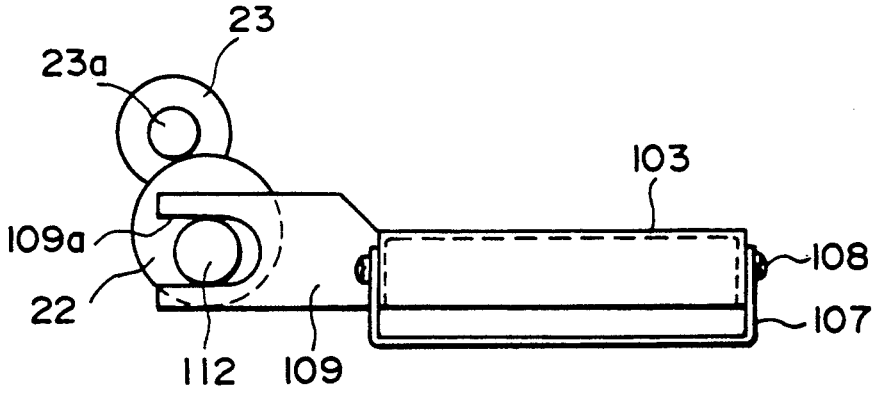
FIG. 15 is a side view showing a jogging mechanism.

Substantially a longitudinal center of the heater 103 is rotatably supported on a pin 108 threaded in a heater fixing plate. As shown in FIGS. 14 and 15, a fork portion 109*a* of the arm 109 extended from one end of the heater 103 is engaged with an eccentric cam 112 of an eccentric cam gear 22 rotatably mounted on the apparatus 1. The eccentric cam gear 22 is meshed with a gear 23*a* mounted on a shaft of the heater jogging motor 23 fixed on the apparatus 1. The heater 103 is disposed below and close to the guide plates 5 and 6. The sensor 25 (corresponding to SW of FIG. 9) is mounted on the fixed guide plate 5, and a sensing element 25*a* of the sensor 25 is mounted on the inside of the guide plate 5, and the sensor 25 detects the material inserted. The slide volume 26 is mounted on the horizontal projection 9 above and in parallel with the belt 11.

Figure 16:
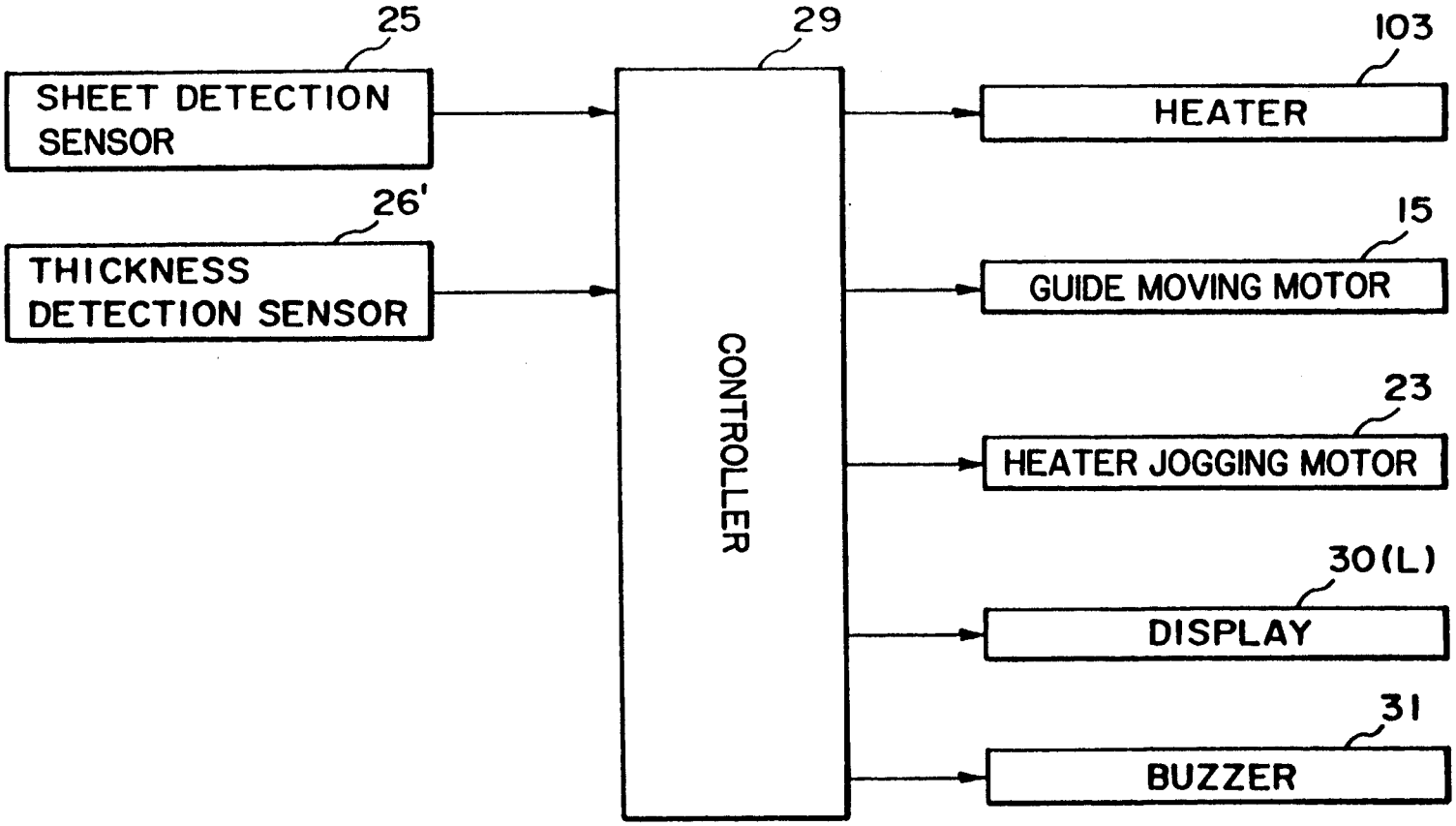
FIG. 16 is a block diagram illustrating the control operation of the apparatus.

As shown in FIG. 16, the control system 29 receives outputs from the sensor 25 for detecting presence and absence of the sheet materials, the thickness detecting sensor 26' constituted by the slide volume 26. The control system 29, responsive to these signals, transmits signals to the drivers of the heater 103, the guide moving motor 15, the heater jogging motor 23, the display 30 and the buzzer 31 so as to drive them. It further controls the operation of the apparatus 1 using an unshown sensor for the heater 3, a timer of the control system and memory means of the control system.

In operation, the power is supplied to the sheet material binding apparatus 1. Then, the sheet materials 105 to be bound is sandwiched by a cover material 106 having a heat-fusable bonding agent at the bottom thereof. When the heater 103 reaches a pre-heated state, it is notified in the display 30 that the covering material 106 can be set in the apparatus, on the display 30 shown in FIG. 16.

The covering material 106 sandwiching the sheet materials 105 is inserted between the guide plates 5 and 6 until it is abutted to a side guide 104.

When the covering material 106 is detected by the sensor 25, the guide moving motor 15 starts to rotate with a time delay $t_0$ determined by an unshown timer, by which the movable guide plate 6 moves for a time period which is sufficient to sandwich the sheet materials 105 through the covering material 106 by the movable and fixed guide plates. When the thickness of the set of sheet materials 105 is large, the torque limiter 13 slides for a long period, whereas when the set of sheet materials 105 has a small thickness, the sliding period of the torque limiter 13 is short. Thus, the sheet materials 105 receive a constant pressure from the guide plate moving motor 15 due to the provision of the torque limiter 13. As an alternative, the output of the motor 35 may be properly selected so that when the pressure increases beyond a predetermined level, the motor 15 is locked, by which the constant pressure can be maintained without the torque limiter 13. At this time, the sheet material set thickness detection sensor 26' constituted with the slide volume 26 detects the thickness of the set of materials 105. The detection signal is supplied to the control system 29, which then determines the heating period $t_1$ (approximately 30 sec for 10 mm thickness) as shown in FIG. 6A and which brings the heater 103 into a heating state (approximately 150° C.). The heating is continued for the period $t_1$. The heating period $t_1$ is displayed on the display 30. The rest of the period may be displayed to facilitate the operation.

After the start of the heating operation, the guide moving motor 15 reverses its rotation to add a small clearance (1 mm–2 mm approximately) between the interval between the guide plates 5 and 6 after a short reversing period $t_2$ to improve the impregnation of the bonding agent. The short reversing period $t_2$ may be increased with the increase of the thickness of the set of sheet materials 105, as shown in FIG. 6C, to further improve the impregnation of the bonding agent.

When the heating period $t_1$ ends, the controlling system 29 determines the jogging period $t_3$ (approximately 10 sec), as shown in FIG. 6B. Then, the jogging motor 10 rotates for the period $t_3$, by which the heater 103 is swingingly vibrated for the period $t_3$ to improve the impregnation of the bonding agent heated and fused into between the adjacent sheet materials 105. Simultaneously, the deviation of the sheet material 105 is prevented by an abutting plate 104. At this time, if the vertical swinging angle at the abutting plate side is large below the horizontal plate, the effect of moving toward the abutting plate is provided. The jogging period $t_3$ may be increased with increase of the thickness of the set of sheet materials to increase the sheet aligning effects and the impregnation of the bonding agent between the sheet materials 105.

When the jogging period ($t_3$) ends, the buzzer 51 is actuated to notify the operator of the end, and simultaneously, the guide moving motor 35 is reversely rotated to expand the interval between the guide plates 1 and 2 to be prepared for the next binding operation. The interval between the guides 5 and 6 may be expanded after the sheet materials are taken out.

In the embodiment, the jogging period $t_3$ is controlled in accordance with the thickness of the set of sheet materials 105, but the number of vibrations and/or amplitude of the vibration of the heater may be changed.

While the invention has been described with reference to the structures disclosed herein, it is not confined to the details set forth and this application is intended to cover such modifications or changes as may come within the purposes of the improvements or the scope of the following claims.

What is claimed is:

1. A sheet material binding apparatus for binding sheet materials with a covering material by a heat-adhesive bonding agent, comprising:

guiding means having an openable pair of guiding members for supporting the covering material and the sheet materials when said guiding members are in a closed position with the covering material and sheet materials sandwiched therebetween;

heating means for heating a bonding agent on a spine of the covering material supported on said guiding means;

guide driving means for providing driving power to move said guiding means in a direction of a thickness of a set of the sheet materials;

detecting means for detecting the setting of the covering material and the sheet materials between said guiding means; and control means for controlling said guiding means to close said pair of guiding members when said detecting means detects insertion of the covering material and the sheet materials in said guiding means and to open said pair of guiding members when said detecting means detects removal of said covering material and sheet materials from said guiding means.

2. An apparatus according to claim 1, wherein said guide driving means includes a torque limiter which operates when the guiding means moves in a direction sandwiching the covering material.

3. An apparatus according to claim 1, further comprising means for detecting a thickness of the set of sheet materials in interrelation with movement of said guiding means in a direction of sandwiching the covering material.

4. An apparatus according to claim 3, further comprising second control means for controlling a heating condition of said heating means in accordance with a thickness of the set of sheet materials.

5. An apparatus according to claim 1, wherein said heating means comprises a heating plate and said heating plate is supported for jogging movement.

6. An apparatus according to claim 5, wherein said heating plate is swingably supported on a shaft extending in a direction of the thickness of the set of sheet materials.

7. An apparatus according to claim 1, further comprising detecting means for detecting setting of the covering material, wherein said guide driving means operates in response to an output of said detecting means to move said guiding means so as to sandwich the covering material and sheet materials thereby, and thereafter, said guide driving means operates in a reverse direction to lightly sandwich the covering material and sheet materials.

8. An apparatus according to claim 7, wherein the guiding means is controlled by said control means so that the guiding means is slightly moved back after said guiding means sandwiches the covering material and sheet materials.

9. An apparatus according to claim 7, wherein said control means controls said guiding means so that said guiding means moves back slightly after start of heating operation of said heating means.

10. A sheet material binding apparatus for binding sheet materials with a covering material by a heat-adhesive bonding agent, comprising:

a guiding means having a pair of guiding members movable between a first position in which said guiding members are spaced by a distance larger than a thickness of a covering material and sheet materials and a second position in which the covering material and the sheet materials are sandwiched therebetween;

heating means for heating a bonding agent on a spine of the covering material supported on said guiding means;

guide driving means for providing driving power to move said guiding means in a direction of a thickness of a set of the sheet materials;

detecting means for detecting insertion of the covering material and sheet materials between said guiding members;

control means, responsive to said insertion detecting means, for bringing said pair of guiding members to a third position which is between the first and the second position by said guide driving means, before completion of heating of said heating means.

11. An apparatus according to claim 10, further comprising means for displaying a time period required for binding the covering material and the sheet materials, wherein said displaying means shows the time period decrimenting.

12. An apparatus according to claim 11, wherein said display means includes a lamp.

13. A sheet material binding apparatus for binding sheet materials with a covering material by a heat-adhesive bonding agent, comprising:

a heating plate on which the spine of the covering material having the bonding agent is placed, said heating plate being used to heat the bonding agent;

guiding means for supporting the covering material and the sheet materials vertically on the heating plate;

guide driving means for providing driving power to move said guiding means in a direction of a thickness of a set of the sheet materials;

detecting means for detecting insertion of the covering material and the sheet materials between said guiding means;

control means, responsive to said detecting means, for closing said guiding means by said guide driving means, and thereafter slightly opening said guiding means;

supporting means for swingably supporting said heating plate about an axis extending in a direction of a thickness of the set of sheet materials; and edge guiding means for guiding edges of the sheet materials, wherein the edges of the sheet materials are abutted to said edge guiding means by a swinging movement of said heating plate.

14. An apparatus according to claim 13, wherein said heating plate swings between a substantially horizontal state and an inclined state in which those edges of the sheet materials which are contacted to said edge guiding means are lowered.

15. A sheet material binding apparatus for binding sheet materials with a covering material by a heat-adhesive bonding agent, comprising:

a heating plate on which the spine of the covering material having the bonding agent is placed, said heating plate being used to heat the bonding agent;

guiding means for supporting the covering material and the sheet materials vertically on the heating plate;

supporting means for swingably supporting said heating plate about an axis extending in a direction of a thickness of the set of sheet materials; and edge guiding means for guiding the edges of the sheet materials, wherein the edges of the sheet materials are abutted to said edge guiding means by a swinging movement of said heating plate.

16. An apparatus according to claim 15, wherein said heating plate swings between a substantially horizontal state and an inclined state in which those edges of the sheet materials which are contacted to said guiding means are lowered.

17. A sheet material binding apparatus wherein edges of sheet materials are placed on a heat-adhesive bonding agent, and they are placed on a supporting table, where the bonding agent is heated to bind the sheet materials, comprising:

a supporting member by swingably supporting the supporting table, said supporting member being extended in a direction of a thickness of a set of the sheet materials and being swingable about an axis extending in said direction;

an abutment member positioned in a vertical plane which is perpendicular to the supporting table when the supporting table is positioned in a horizontal plane, wherein said abutment member is a confining boundary of the vertical edges of the sheet materials positioned on the supporting table; and means for swinging said supporting member, wherein said supporting table swings downwardly from a horizontal plane at a side where the abutment member is provided.

18. An apparatus according to claim 17, wherein said supporting table swings downwardly from a horizontal plane at a side where the abutment member is provided.

* * * * *

UNITED STATES PATENT AND TRADEMARK OFFICE

CERTIFICATE OF CORRECTION

PATENT NO. : 5,252,018
DATED : October 12, 1993
INVENTOR(S) : MAKOTO KITAHARA, ET AL.

It is certified that error appears in the above-indentified patent and that said Letters Patent is hereby corrected as shown below:

Column 1
Line 13, "conventional" should read --a conventional--.

Column 2
Line 60, "of" should read --of a--.

Column 5
Line 45, "plate" should read --plates--;
Line 50, "Referring" should read --Referring to--.

Column 7
Line 63, "is" should read --are---.

Column 8
Line 47, "into" should read --in--.

Column 12
Line 3, "by" should read --for--.

Signed and Sealed this

Third Day of May, 1994

Bruce Lehman

*Attest:*

BRUCE LEHMAN

*Attesting Officer*

*Commissioner of Patents and Trademarks*